US009187199B2

(12) United States Patent
Maccagnani et al.

(10) Patent No.: US 9,187,199 B2
(45) Date of Patent: Nov. 17, 2015

(54) UNIT FOR THE APPLICATION OF OPENING DEVICES ON PACKAGES OF FOOD PRODUCTS POURABLE INTO A TUBE OF PACKAGING MATERIAL

(75) Inventors: Andrea Maccagnani, Modena (IT); Lars Skarin, Uddevalla (SE); Mahmod Tabarte, Munkedal (SE); Urban Johansson, Vanersborg (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 1175 days.

(21) Appl. No.: 13/125,218

(22) PCT Filed: Dec. 7, 2009

(86) PCT No.: PCT/EP2009/066552

§ 371 (c)(1),
(2), (4) Date: Apr. 20, 2011

(87) PCT Pub. No.: WO2010/066691

PCT Pub. Date: Jun. 17, 2010

(65) Prior Publication Data

US 2011/0203225 A1 Aug. 25, 2011

(30) Foreign Application Priority Data

Dec. 9, 2008 (IT) ..... TO2008A0915

(51) Int. Cl.
*B65B 61/18* (2006.01)
*B31B 1/84* (2006.01)

(52) U.S. Cl.
CPC ..... *B65B 61/186* (2013.01)

(58) Field of Classification Search
CPC .. B67B 3/2033; B67B 3/2066; B65B 7/2835; B65B 61/186; B29C 65/00; B31B 1/84; B31B 2201/9085; B29L 2031/7166
USPC ..... 53/317, 319, 331.5, 334, 336, 342, 349, 53/353; 493/309, 311, 102, 104, 108, 114, 493/121, 87
See application file for complete search history.

(56) References Cited

U.S. PATENT DOCUMENTS 4,548,668 A * 10/1985 Roth et al. ..... 156/357
6,378,271 B1 * 4/2002 Skinner et al. ..... 53/410
7,762,043 B2 * 7/2010 Skarin et al. ..... 53/133.2

(Continued)

FOREIGN PATENT DOCUMENTS

CN 201006638 Y 1/2008
DE 20 2006 013 044 U1 9/2007

(Continued)

OTHER PUBLICATIONS

Chinese Office Action (Second) dated Jul. 30, 2013, issued by the State Intellectual Property Office, P.R. China in corresponding Chinese Patent Application No. 200980149070.0 and an English Translation thereof of the Chinese Office Action. (16 pgs).

(Continued)

*Primary Examiner* — Andrew M Tecco
(74) *Attorney, Agent, or Firm* — Buchanan Ingersoll & Rooney PC

(57) ABSTRACT

A unit for applying opening devices on packages of pourable food products, comprises a first conveying device to feed the opening devices along a first path, a second conveying device to feed the packages along a second path, a third conveying device movable about a first axis to displace the opening devices along a third path from a withdrawal station to an application station of the opening devices, a gripping member for gripping an opening device, and a supporting plate to support the gripping member; wherein the supporting plate is coupled to the third conveying device; the gripping member is displaceable, at the application station in a defined plane by a first direction transversal to the first axis and to the second path, and by the first axis.

19 Claims, 10 Drawing Sheets

(56) References Cited

U.S. PATENT DOCUMENTS

| | | | | |
|---|---|---|---|---|
| 8,161,713 | B2 * | 4/2012 | Skarin et al. | 53/133.2 |
| 8,920,297 | B2 * | 12/2014 | Maccagnani et al. | 493/87 |
| 2005/0173438 | A1 | 8/2005 | Berggren | |
| 2006/0236655 | A1 * | 10/2006 | Cavilli et al. | 53/133.1 |
| 2006/0272284 | A1 * | 12/2006 | Galimberti et al. | 53/75 |
| 2009/0025337 | A1 * | 1/2009 | Skarin et al. | 53/133.1 |

FOREIGN PATENT DOCUMENTS

| | | | |
|---|---|---|---|
| EP | 1 471 009 | A1 | 10/2004 |
| EP | 1 813 533 | A1 | 8/2007 |
| RU | 2 301 149 | C2 | 6/2007 |

OTHER PUBLICATIONS

International Search Report (PCT/ISA/210) issued on Mar. 30, 2010, by European Patent Office as the International Searching Authority for International Application No. PCT/EP2009/066552.

Written Opinion (PCT/ISA/237) issued on Mar. 30, 2010, by European Patent Office as the International Searching Authority for International Application No. PCT/EP2009/066552.

Office Action (Decision on Grant) issued on Sep. 16, 2014, by the Russian Patent Office in corresponding to Russian Patent Application No. 2011128451, and an English translation of Office Action. (15 pages).

* cited by examiner

UNIT FOR THE APPLICATION OF OPENING DEVICES ON PACKAGES OF FOOD PRODUCTS POURABLE INTO A TUBE OF PACKAGING MATERIAL

The present invention relates to a unit for the application of opening devices on packages of food products pourable into a tube of packaging material.

BACKGROUND ART

As is known, many pourable food products, such as fruit juice, UHT (ultra-high-temperature treated) milk, wine, tomato sauce, etc., are commercially available in sealed packages made of a packaging material that has previously been sterilised.

A typical example of this type of package is the parallelepiped-shaped package for liquid or pourable food products known as Tetra Brik Aseptic (registered trademark), which is made by folding and sealing laminated strip packaging material.

The packaging material has a multi-layer structure substantially comprising a base layer for stiffness and strength, which may comprise a layer of fibrous material, e.g. paper, or of mineral-filled polypropylene material, and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution. Once sterilization is completed, the sterilization agent is removed from the surfaces of the packaging material, e.g. evaporated by heating. The web of packaging material sterilized in this manner is maintained in a closed, sterile environment, and is folded and sealed longitudinally to form a vertical tube.

The tube is filled with the sterilized or sterile-processed food product, and is sealed at equally spaced cross sections, along which it is eventually cut to form the packs. These pillow-shaped packs are then folded mechanically to form finished, e.g. substantially parallelepiped-shaped, packages.

Alternatively, the packaging material may be cut into blanks, which are formed into packages on forming spindles. These packages are filled with the food product and sealed. One example of this type of package is the so-called "gable-top" package known by the trade name Tetra Rex (registered trademark).

Once formed, the aforementioned packages may undergo further processing, such as applying a reclosable opening device to protect the food product inside the package from contact with external agents, and to enable the product to be poured out.

At present, the most commonly marketed opening devices comprise a frame defining a pour opening and fitted about a pierceable or tear-off portion of a top wall of the package, and a cap hinged or screwed to the frame, which is removable to open the package; as an alternative, the use of different types of opening devices, such as slidingly operated opening devices, are also known.

The pierceable portion of the package may be defined e.g. by a so-called "prelaminated" hole, i.e. a hole formed in the base layer of the packaging material before coupling this layer with the layer of barrier material, which is therefore intact and closes the hole itself, thus ensuring hermetic sealing and asepsis although resulting easy to perforate.

In the case of aseptic packaging machines, the opening devices are normally fitted directly to the packages, after they are formed, in units placed on the production line downstream from the packaging machine.

The aforementioned units substantially comprise a gluing assembly within which a fastening portion of the opening devices is coated with a layer of adhesive, an application assembly within which the opening devices are applied on respective packages and a pressure assembly within which the opening devices are pressed on the respective packages for a time required to allow the cooling of the adhesive and the complete adhesion of each opening device on the corresponding package.

Application assemblies are known, e.g. from patent EP1813533, comprising a first linear step conveyor adapted to feed a sequence of packages along a first rectilinear path, a second linear step conveyor adapted to feed a sequence of opening devices along a second rectilinear path, and a rotating carousel conveyor which is also step operated, which is adapted to carry the opening devices from a withdrawal station coinciding with a stop station of the second conveyor to an application station of the opening devices on the respective packages coinciding with a stop station of the first conveyor.

Each gripping member is movably constrained to the carousel conveyor radially to a rotation axis of the carousel conveyor between a retracted position and an advanced position.

More specifically, each gripping member is placed at a maximum and at a minimum radial distance from the axis of the carousel conveyor respectively in the corresponding advanced and retracted position.

Each gripping member is arranged in the advanced position when it withdraws the opening device from the first conveyor, it is advanced in the retracted position from the carousel conveyor, and it is arranged in the advanced position when it applies the opening device onto the corresponding package.

Specifically, each gripping member applies the opening device on the corresponding package in a direction perpendicular to a top wall of the package and radial with respect to the axis of the carousel conveyor, so as to arrange the flat fastening area of the opening device parallel to and in contact with the top wall of the package itself.

Although more reliable and effective, the disclosed application assemblies may further be improved.

Specifically, a need is felt for maximum flexibility as regards the approaching trajectory of the gripping means to the packages advancing along the first path during the step of applying opening devices onto the respective packages.

This flexibility is especially advantageous when the fastening area of the opening devices on the corresponding packages does not lie on a single plane. Indeed, in this case advancing the gripping member exclusively in a radial direction towards the advancing package would not arrange the aforementioned fastening area totally resting against the wall of the package.

The adhesive could therefore escape from the fastening area and the gluing efficiency of the opening devices on the corresponding packages could therefore be compromised.

This need is especially felt in relation to opening devices fitted with a frame straddling an edge between a first and a second wall of the package, e.g. the top wall and the top end portion of a side wall of the package, and comprising a first and second portion forming an angle therebetween and intended to be glued respectively to the aforementioned first and second wall at respective fastening areas lying on respective reciprocally inclined planes.

DISCLOSURE OF INVENTION

It is the object of the present invention to provide an application unit of opening devices on packages of food products pourable into a tube of packaging material allowing to meet the aforementioned need in a simple and cost-effective manner.

The aforementioned object is achieved by a unit for the application of opening devices on packages of food products pourable into a tube of packaging material according to claim 1.

BRIEF DESCRIPTION OF THE DRAWINGS

Two preferred embodiments are hereinafter disclosed for a better understanding of the present invention, by way of non-limitative example and with reference to the accompanying drawings, in which.

BEST MODE FOR CARRYING OUT THE INVENTION

Figure 1:
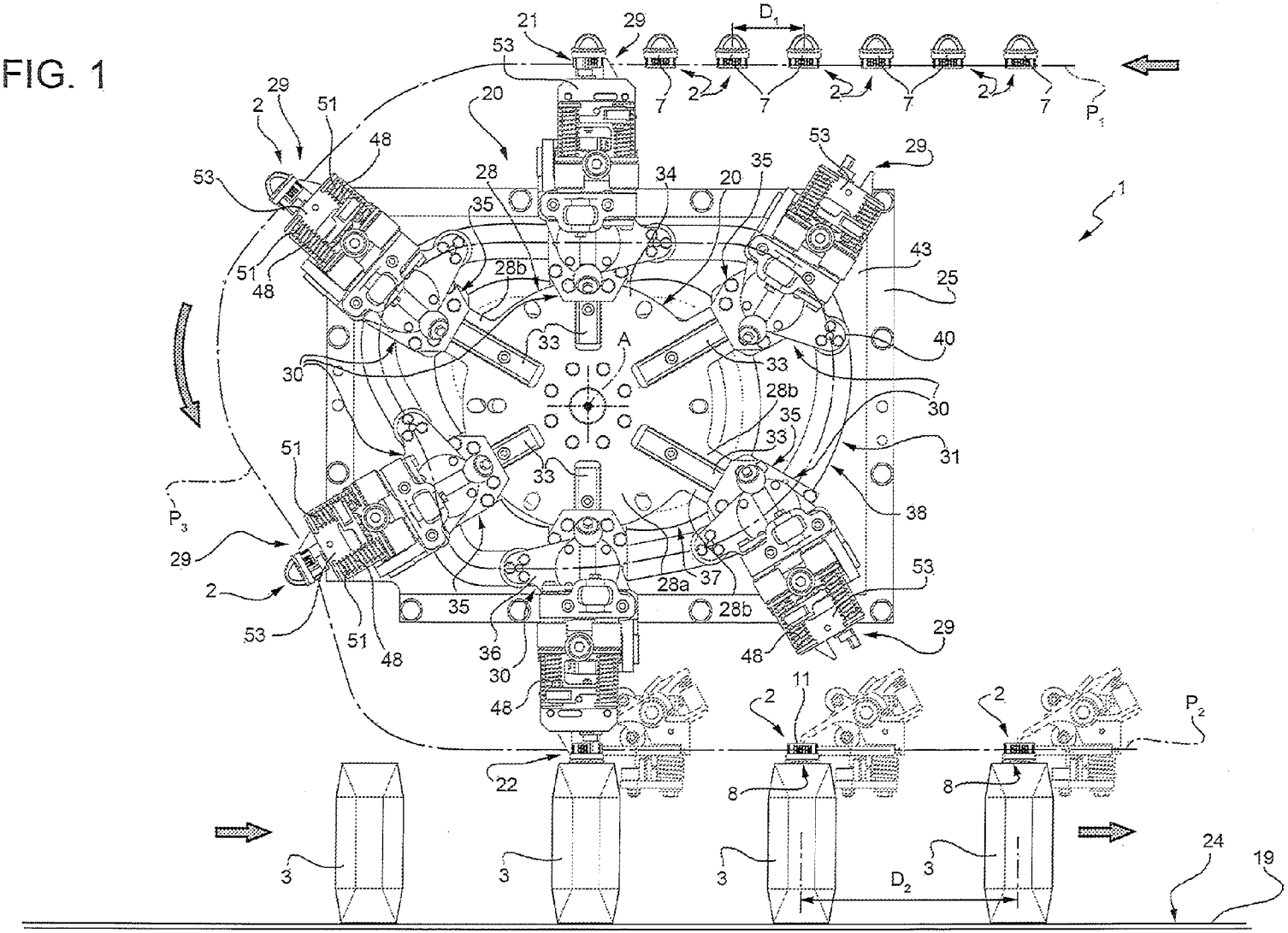
FIG. 1 is front view of a unit for the application of opening devices on packages of food products pourable into a tube of packaging material made according to the present invention, with parts removed for the sake of clarity.

With reference to FIG. 1, numeral 1 indicates a unit for the application of opening devices 2 on sealed packages 3 of food products pourable into a tube of packaging material.

Packages 3 are produced upstream of unit 1 by a packaging machine from a sheet packaging material comprising a base layer, e.g. formed by cardboard-like fibrous material or mineral-filled polypropylene material, and a number of layers of heat-seal plastic material, e.g. polyethylene film, covering both sides of the base layer. When packages 3 are intended for aseptic packaging of long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of packages 3 eventually contacting the food product.

Preferably, the machine manufactures sealed packages 3 containing a pourable food product, such as UHT or pasteurised milk, fruit juice, wine, etc.

The packaging machine could also manufacture sealed packages 3 containing a food product, which may be poured within the tube of packaging material during the step of manufacturing packages 3 and subsequently hardens upon sealing of aforementioned packages 3. An example of the latter food product is a portion of cheese, which is melted during the step of manufacturing packages 3 and subsequently hardens upon sealing of aforementioned packages 3.

Figure 9:
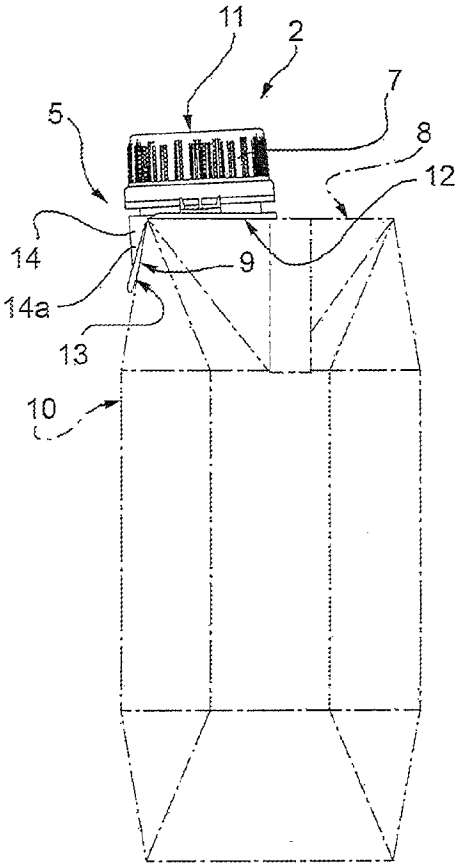
FIG. 9 shows the opening device of FIG. 8 once applied on a package by the unit of FIGS. 1 and 2.

Opening device 2 is adapted to be applied on a package 3 (shown in FIGS. 1, 5 and 9) at a removable portion thereof, i.e. a portion detachable from the remaining part of package 3 to allow the outflow of the pourable product.

The removable portion may consist of a sealing sheet applied by gluing or heat sealing on package 3 to close a through-hole thereof; as an alternative, the removable portion may be defined by a so-called "prelaminated" hole, i.e. a hole formed in the base layer of the packaging material and closed hermetically by other layers (at least the layers of thermoplastic material) of the packaging material.

Figure 8:
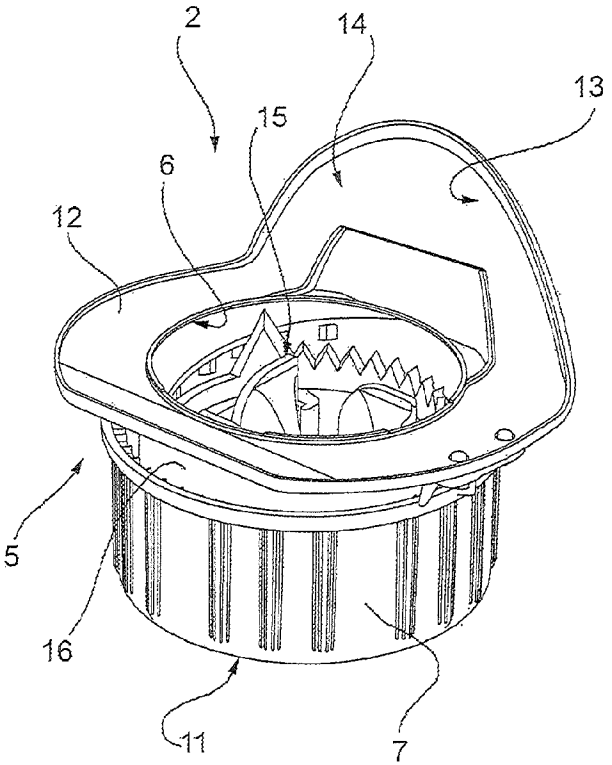
FIG. 8 shows a strongly enlarged view of an example of an opening device applied by unit 1 on a corresponding package.

An example of opening devices 2 is shown in FIG. 8 and will be used as a reference in the following description without loosing in generality.

Opening device 2 substantially comprises:

- a frame 5 intended to be applied on package 3 about a pierceable portion and provided with a circular opening 6 through which the food product is poured;
- a removable cap 7 of the screw type, adapted to be applied on frame 5 in a closed position of opening 6; and
- a cutting element 15 engaging opening 6 in use and adapted to interact with the pierceable portion of package 3 to determine the partial detachment thereof from the remaining part of the packaging material so as to achieve the opening of package 3.

Frame 5 straddles an edge between two adjacent walls of package 3, e.g. a flat top wall 8 and a top end portion 9 of a side wall 10 adjacent to wall 8 (FIG. 9), and comprises a pair of fastening portions 12, 13 which are arranged so as to form a predetermined angle to each other and are respectively fastened to the top and side wall of package 3.

Specifically, frame 5 comprises a flange 14 defining portions 12, 13, and a threaded collar 16 (FIG. 8) delimiting opening 6 and for receiving cap 7.

Portion 12 is substantially annular and portion 13 protrudes from portion 12 on the side opposite to collar 16.

The angle between portions 12, 13 of flange 14, on the opposite side, in use, to walls 8 and 10 of package 3, is preferably 90° or over and less than 180°.

On the opposite side to flange 14, cap 7 is bounded by a flat surface 11 sloping at an acute angle with respect to wall 8 of package 3.

On the opposite side to portion 13, flange 14 also comprises a flat wall 14*a* sloping with respect to portion 13 and wall 8, and substantially perpendicular to surface 11.

Collar 16 protrudes from flange 14 and, once opening device 2 has been applied to package 3, extends on the opposite side of the side of flange 14 facing walls 8, 10 of package 3.

With reference to FIG. 1, unit 1 substantially comprises a supporting structure 25, a first linear conveyor (not shown), which is adapted to feed a sequence of opening devices 2 along a rectilinear and horizontal path $P_1$, a second linear conveyor 19, also known per se and only diagrammatically shown, which is adapted to feed a sequence of packages 3 along a rectilinear and horizontal path $P_2$, shown parallel and in opposite direction with respect to path $P_1$ in the example, and a carousel conveyor 20 adapted to feed opening devices 2 from a withdrawal station 21, arranged along path $P_1$, to an application station 22 of opening devices 2 on respective packages 3, arranged along path $P_2$.

The first conveyor defines, at least near station 21, a horizontal feeding plane, on which opening devices 2 are arranged with cap 7 facing downwards and facing carousel conveyor 20 and with portions 12, 13 arranged on the opposite side to carousel conveyor 20.

Supporting structure 25 also bears an adhesive (specifically high-temperature melted glue) dispensing device (not shown), which is adapted to act on opening devices 2 during advance thereof on the first conveyor; very briefly, the dispensing device comprises a number of dispensing guns aligned parallelly to path $P_1$ and each adapted to dispense the adhesive on portions 12, 13 of a respective opening device 2.

Conveyor 19 is arranged in a lower position with respect to the first conveyor and defines, at least near application station 22, a horizontal feeding plane 24, on which packages 3 rest so as to have their walls 8 arranged upwards in a horizontal position and facing carousel conveyor 20. More specifically, packages 3 rest on feeding plane 24 so that respective walls 8 lie parallel to path $P_2$.

In the case shown, the step between opening devices 2 along the first conveyor, indicated by $D_1$, is different from, and more precisely shorter than, the step between packages 3 along conveyor 19, indicated by $D_2$. It should be understood that the term "step" means the distance between homologous points on two adjacent opening devices 2 or on two adjacent packages 3.

Carousel conveyor 20 is arranged in a position interposed between the first conveyor and conveyor 19.

Carousel conveyor 20 is continuously rotatable about a horizontal axis A thereof, which is perpendicular to paths $P_1$ and $P_2$, and is adapted to feed opening devices 2 along a curvilinear path $P_3$ to carry them from station 21 to station 22.

With specific reference to FIG. 1, carousel conveyor 20 comprises a wheel 28 having axis A, and a plurality of gripping members 29 which are uniformly distributed about axis A and are mounted on wheel 28 so as to radially project therefrom.

Unit 1 further comprises a plurality of constraining assemblies 30 to movably constrain respective gripping members 29 to wheel 28, and cam guide means 31 to vary the position of each gripping member 29 with respect to wheel 28 during the motion of wheel 28; step $D_1$ between opening devices 2 along path $P_3$ may thereby be varied in order to be adapted to the requirements of possible specific operations to be carried out on opening devices 2 and in order for it to be identical to step $D_2$ between packages 3 at station 22.

Constraining assemblies 30 comprise a plurality of guide elements 33 radially extending about axis A and protruding from a head surface 34 of wheel 28, and a plurality of slide elements 35 slidingly coupled to respective guide elements 33 and each bearing a gripping member 29.

Specifically, wheel 28 has a central discoidal portion 28*a*, from which radial expansions 28*b* project peripherally, each bearing a guide element 33.

Each gripping member 29 is borne on a supporting plate 36, which is hinged to slide element 35 on the opposite side of guide element 33 and about a corresponding axis B (FIG. 2) parallel to axis A and perpendicular to supporting plate 36.

Therefore, each gripping member 29 may translate, relatively to wheel 28, along a predefined radial direction with respect to axis A and may oscillate, relatively to wheel 28, about a corresponding axis B perpendicular to, and incident with, this radial direction.

The term incident means that each axis B has a point in common with respective radial direction, and is equivalent with intersecting.

In a further embodiment of unit 1, supporting plate 36 is a strict supporting member which is coupled to wheel 28 for rotation of the gripping members 29, without being slidably connected to slide elements 35 via guide element 33.

Figure 2:
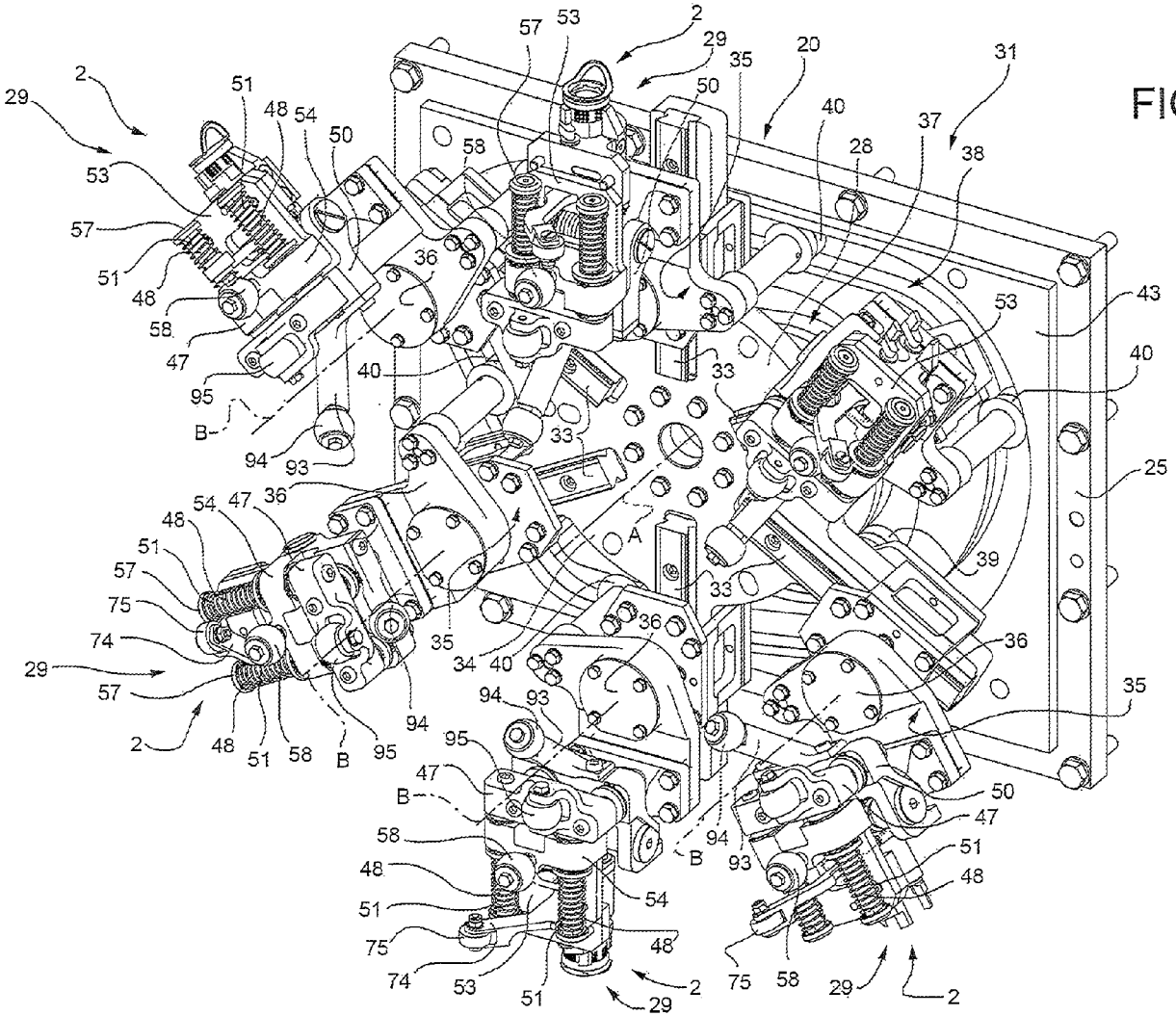
FIG. 2 is an axonometric view of a conveyor of the unit in FIG. 1.
Figure 4:
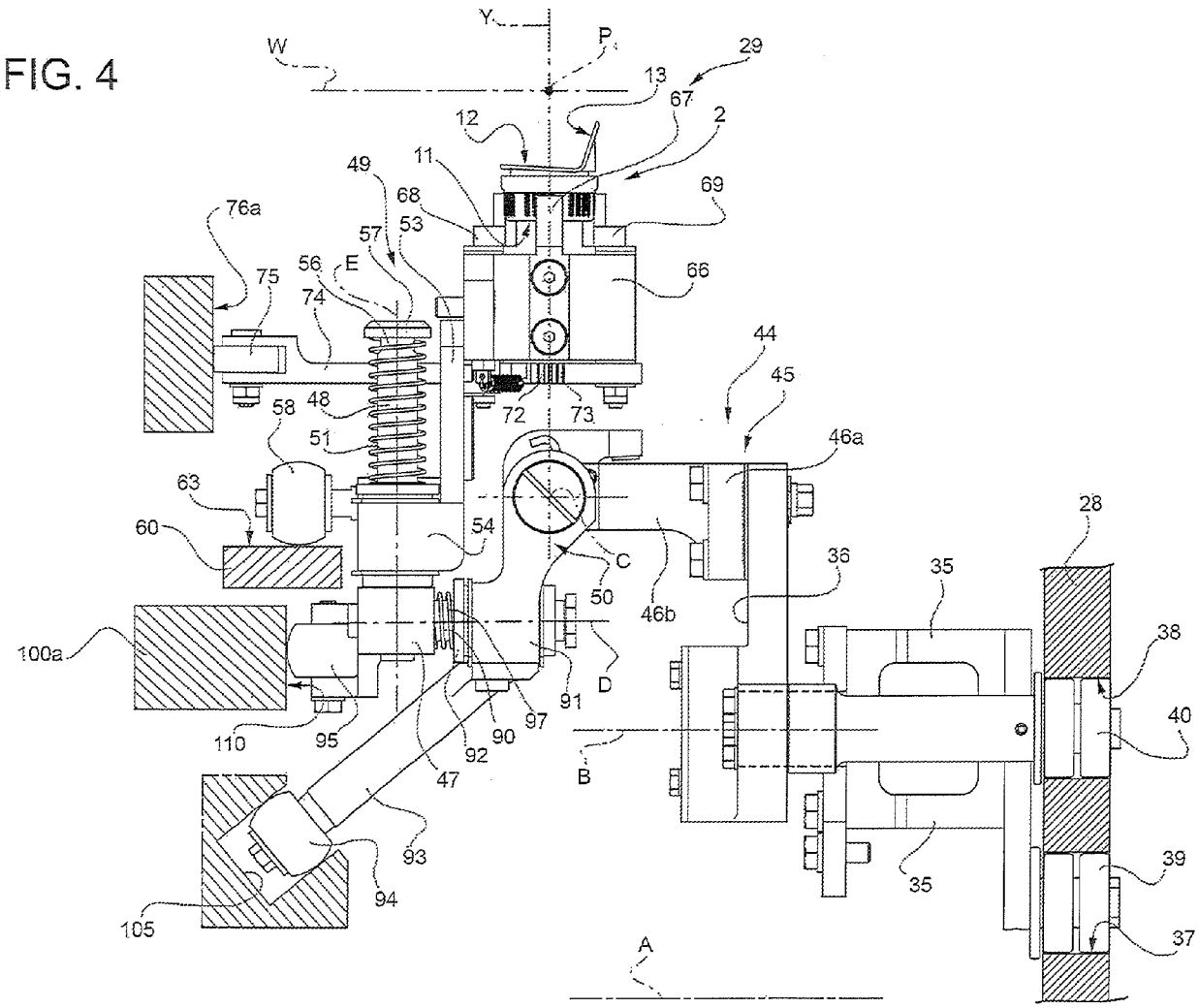
FIGS. 4 and 5 show strongly enlarged views of a gripping member of the unit of FIGS. 1 and 2 respectively in a withdrawal position of an opening device and in an application position of the aforementioned opening device on a corresponding package.
Figure 5:
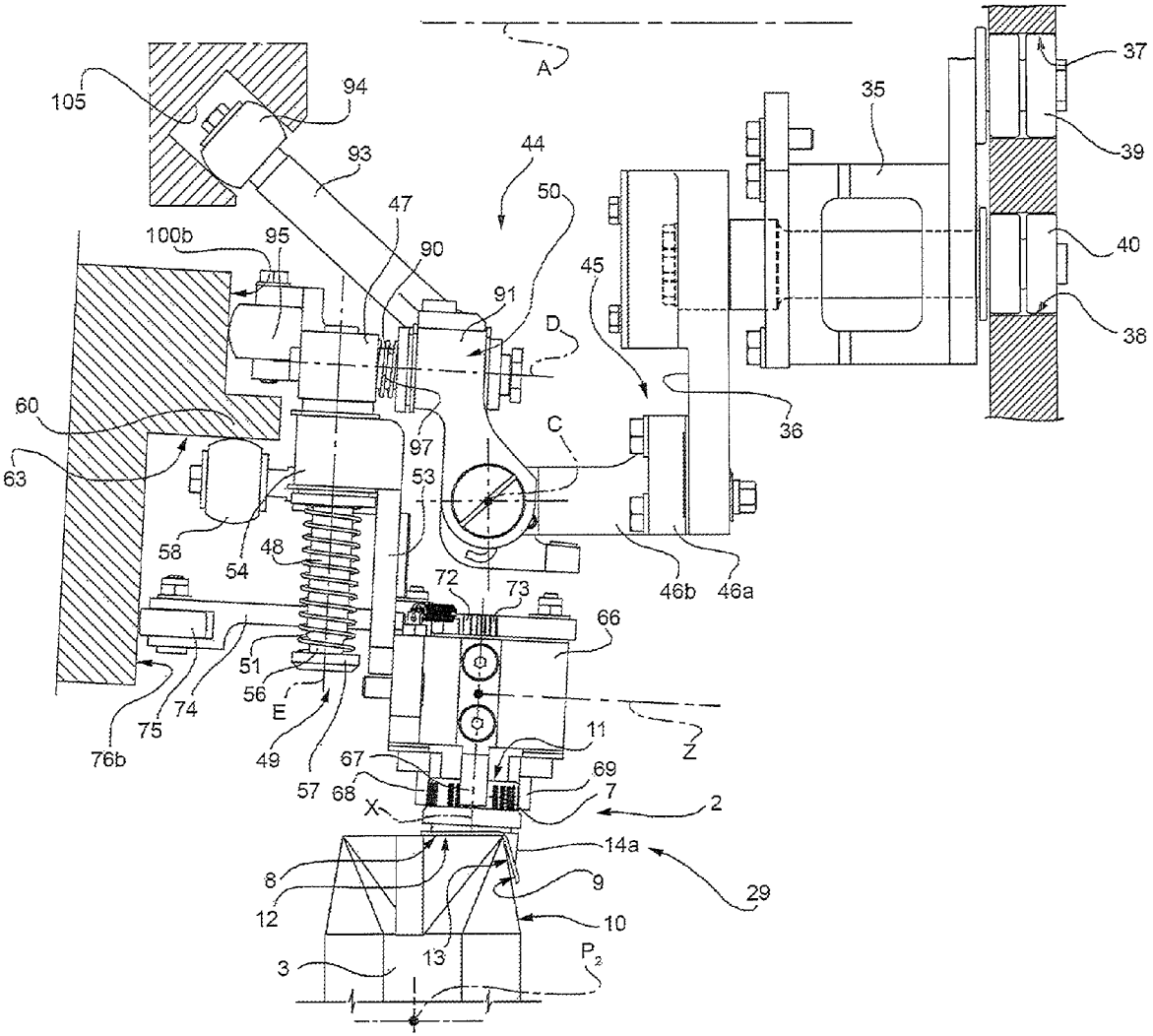

As shown in FIGS. 2, 4, and 5, guide means 31 comprise a pair of fixed curvilinear cams 37, 38 extending continuously about axis A and cooperating with idle cam follower rollers 39, 40, respectively borne by slide element 35 and by supporting plate 36 of constraining assembly 30 of each gripping member 29.

More precisely, cams 37, 38 consist of respective profiled grooves obtained on a fixed vertical wall 43 (FIGS. 1 and 2) arranged facing a head surface of wheel 28 opposite to head surface 34. Cam 38 is arranged, in each portion thereof, radially external to cam 37 with respect to axis A.

In practice, cam 37 controls the radial position of gripping members 29 with respect to axis A during the rotation of wheel 28, while cam 38 controls the orientation of gripping members 29 with respect to relative guide elements 33 and therefore of opening devices 2 with respect to the radius of wheel 28 they are fixed to.

As may be noted in FIG. 1, gripping means 29, and therefore opening devices 2, vary their position with respect to wheel 28 during the rotation thereof, with the subsequent modification of their peripheral speed. This variation of position in the transition from station 21 to station 22 allows the adjustment of the step between opening devices 2 and that ($D_2$) between packages 3.

Each gripping member 29 is displaceable, at station 22, with respect to supporting plate 36 in a plane defined by a direction X transversal with respect to axis A and to path $P_2$, and by a direction Z transversal with respect to direction X.

The term "transversal" means in the present description "not parallel".

In this case, direction X is perpendicular to direction Z and to path $P_2$.

Furthermore, direction X coincides with the centreline of relative gripping member 29.

Since direction Z is parallel to axis A, each gripping member 29 is advantageously displaceable, at station 22, with respect to supporting plate 36 in a plane defined by direction X and axis A.

With reference to FIG. 4, each gripping member 29 is displaceable, at station 21, with respect to supporting plate 36 in a plane defined by:

- a direction Y perpendicular to path $P_1$ and to axis A; and
- a direction W perpendicular to direction Y and parallel to axis A.

In other words, each gripping member 29 is displaceable, at station 21, with respect to supporting plate 36 in a plane defined by:

- direction Y; and
- axis A.

In particular, direction Y is orthogonal to surface 11 of opening devices 2 travelling along path $P_1$ and located at station 21. Direction W is parallel to surface 11 of opening device 2 travelling along path $P_1$ and located at station 21 (FIG. 4).

Furthermore, direction Y coincides with the centreline of each gripping member 29 at station 21.

In greater detail, each gripping member 29 is fixed to supporting plate 36 by means of a support frame 44 (FIGS. 4, 5 and 6), which protrudes from supporting plate 36 on the opposite side of slide element 35.

In greater detail, each frame 44 essentially comprises a body 45 fixed to supporting plate 36, a fastening body 49 integrally bearing gripping member 29, and a lever 50 hinged to fastening body 49 about a corresponding axis C perpendicular to axis A and elastically connected to fastening body 49 by means of a pair of helical springs 90 with respective axes D.

Each axis C specifically extends orthogonally with respect to axis A.

Body 45 of each frame 44 substantially comprises a plate 46*a* fixed parallelly to and against supporting plate 36, and a pair of arms 46*b* perpendicularly protruding from plate 46*a* on the opposite side of corresponding slide element 35.

Lever 50 of each frame 44 substantially comprises a pair of arms 91 hinged on respective arms 46*b* of corresponding body 45 about axis C, a cross member 92 perpendicularly interposed between arms 91 parallelly to axis C and on the opposite side of gripping member 29, and a rod 93 protruding from cross member 92 on the opposite side of arms 91 and provided, at an end opposite to arms 91, with a cam follower roller 94 adapted to cooperate with a fixed cam 105 to determine the rotation of lever 50 about axis C. More precisely, rod 93 of each lever 50 is oblique with respect to axis A.

Figure 6:
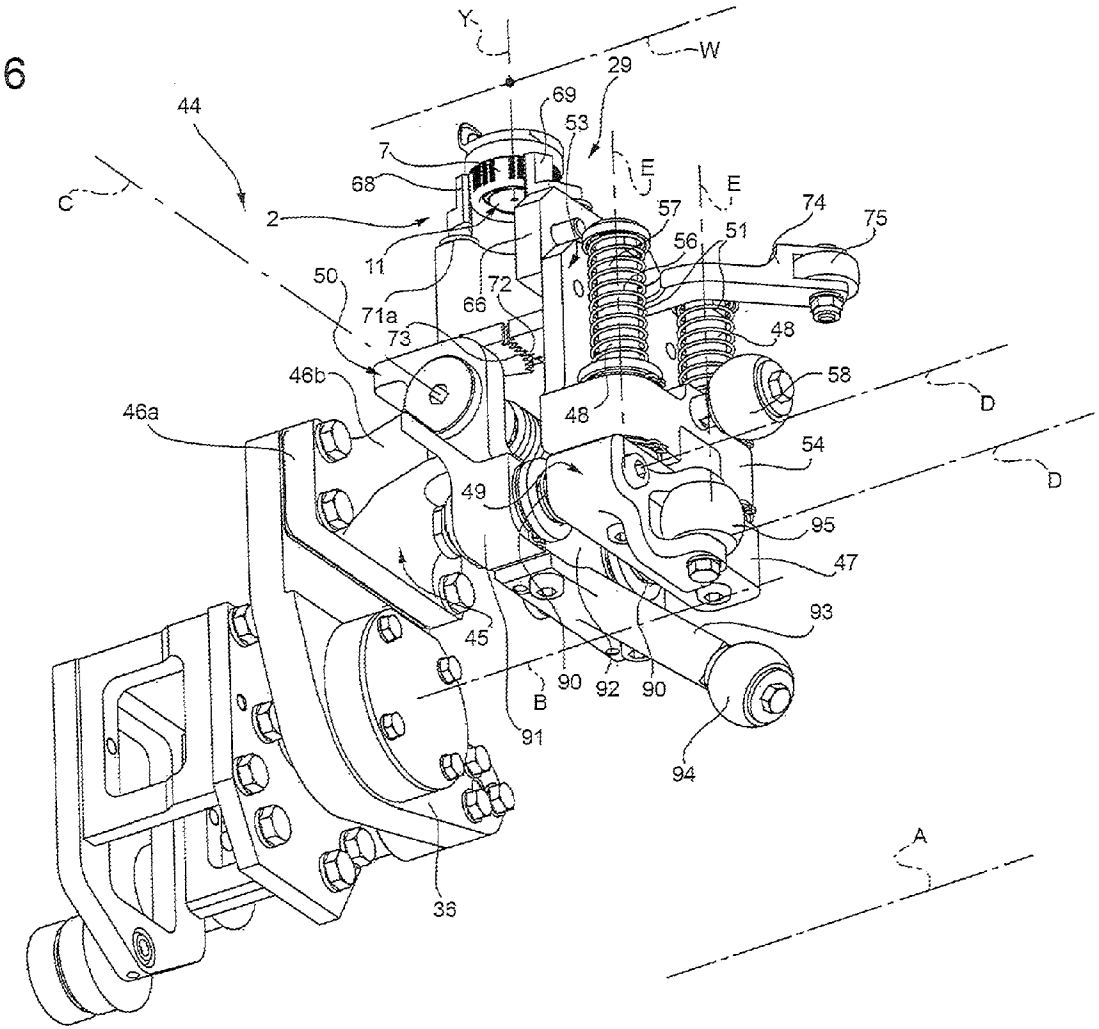
FIG. 6 shows a perspective view of the gripping member of FIGS. 4 and 5 in the withdrawal position.

Arms 91 of each lever 50 are connected by a pin which is elastically connected to arms 91 by means of a helical spring which is coaxial to the pin itself (FIG. 6).

Fastening body 49 of each frame 44 is substantially formed by:

- a body 47 which is elongated parallelly to cross member 92, bears an idle cam follower roller 95 on the side opposite to plate 46*a*, and is elastically connected with cross member 92 of lever 50 by means of springs 90 coaxially wound on respective pins 97 elongated along respective axes D;
- a plate 53 which is elongated perpendicularly to axes D and protrudingly bears gripping member 29 on the opposite side of body 47; and
- an appendix 54 which is integral with plate 53, extends perpendicularly from an end of plate 53 opposite to gripping element 29, and protrudingly bears, on the opposite side of plate 53, a cam follower roller 58 adapted to slidingly cooperate with two fixed cams 60 (shown in FIG. 3), respectively arranged at station 21 and station 22.

Specifically, cam follower roller 95 of each body 47 cyclically cooperates slidingly with two cams 100*a*, 100*b* respectively arranged at stations 21, 22 to displace gripping member 29 parallelly to directions W, Z.

Pins 97 of each frame 44 protrude from cross member 92 on the side opposite to axis C and pass through respective through-holes defined by body 47.

Body 47 of each frame 44 is slidingly coupled to pins 97 parallelly to axis D and is elastically loaded by springs 90 on the opposite side of axis C.

Fastening body 49 of each frame 44 further comprises a pair of pins 48 extending from body 47 along respective axes E perpendicular to axes C and passing through respective through-holes defined by appendix 54.

Each plate 53 and corresponding appendix 54 are slidingly coupled to corresponding pins 48 and are elastically loaded by respective helical springs 51 coaxial to pins 48 towards a first retracted operating position, i.e. having the minimum radial distance from axis A with reference to the specific position along the radius occupied by slide element 35 on guide element 33.

As shown in FIGS. 4 to 6, pins 48 of each frame 44 project from appendix 54 with respective portions 56, and corresponding springs 51 are coaxially wound on respective portions 56 and each interposed between appendix 54 and an annular end shoulder 57 of portion 56 itself.

With specific reference to FIGS. 4 to 7, each gripping member 29 comprises a support body 66 protruding from an end of plate 53 of fastening body 49 opposite to that from which appendix 54 extends, and three gripping jaws 67, 68, 69 projecting from the side of support body 66, which is radially external with respect to axis A, and adapted to house an opening device 2 therebetween; one of jaws (67) is fixed to support body 66 while the other two (68, 69) may oscillate about axes F (FIG. 7) parallel to axes E and perpendicular to axes C.

Figure 7:
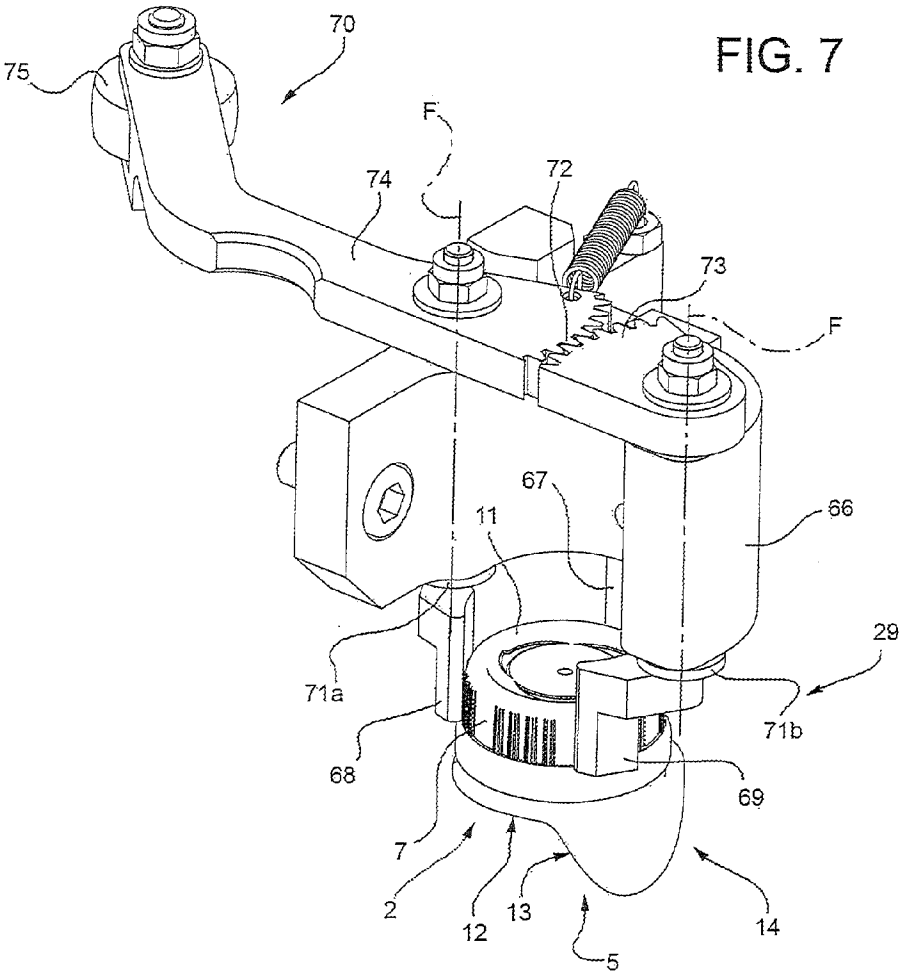
FIG. 7 shows a strongly enlarged perspective view of some details of the gripping member in FIG. 5.

During gripping of opening device 2, jaws 67, 68, 69 of each gripping member 29 result angularly equally spaced from one another about opening device 2 (FIG. 7).

Specifically, jaws 68, 69 of each gripping member 29 are elastically loaded towards a closed position, in which they hold opening device 2 therebetween and against fixed jaw 67, and are selectively displaceable, at stations 21 and 22, in an open position, in which they are drawn apart in order to allow the engagement and the release of opening device 2.

The displacements of jaws 68, 69 of each gripping member 29 are controlled by a lever and cam actuating mechanism 70, shown in detail in FIG. 7.

This actuating mechanism 70 comprises a pair of pins 71*a*, 71*b* mounted in an axially fixed position and rotatably through respective through-holes of support body 66 of gripping member 29 and protrudingly bearing, respectively at opposite ends thereof, jaws 68, 69 and reciprocally engaging toothed sectors 72, 73 projecting from support body 66; one of these toothed sectors (72) defines an end portion of a corresponding lever 74, the other end portion of which is provided with an idle follower cam roller 75, in turn slidingly cooperating with two fixed cams 76*a*, 76*b* (shown in FIGS. 3, 4 and 5), respectively arranged at stations 21 and 22.

Specifically, each lever 74 is elastically connected, at a portion adjacent to toothed sector 72, with support body 66 by means of a helical spring shown in FIG. 7.

Cams 76*a*, 76*b* are arranged on the side opposite to wheel 28 with respect to vertical wall 43 bearing cams 37, 38 and each have a top portion 77 projecting towards wheel 28, from which respective ramp portions 78, 79 depart with opposite inclinations; with reference to the rotation direction of wheel 28, ramp portion 78 of each cam 76*a*, 76*b* approaches wheel 28, while ramp portion 79 moves away from wheel 28.

The sliding of each cam follower roller 75 along each cam 76*a*, 76*b* at first determines the rotation of lever 74 about the axis of corresponding pin 71*a* with the subsequent and simultaneous displacement of jaws 68, 69 in the open position, reached at top portion 77, and then determines the rotation in the opposite direction of lever 74 itself with jaws 68, 69 returning to the closed position.

Figure 3:
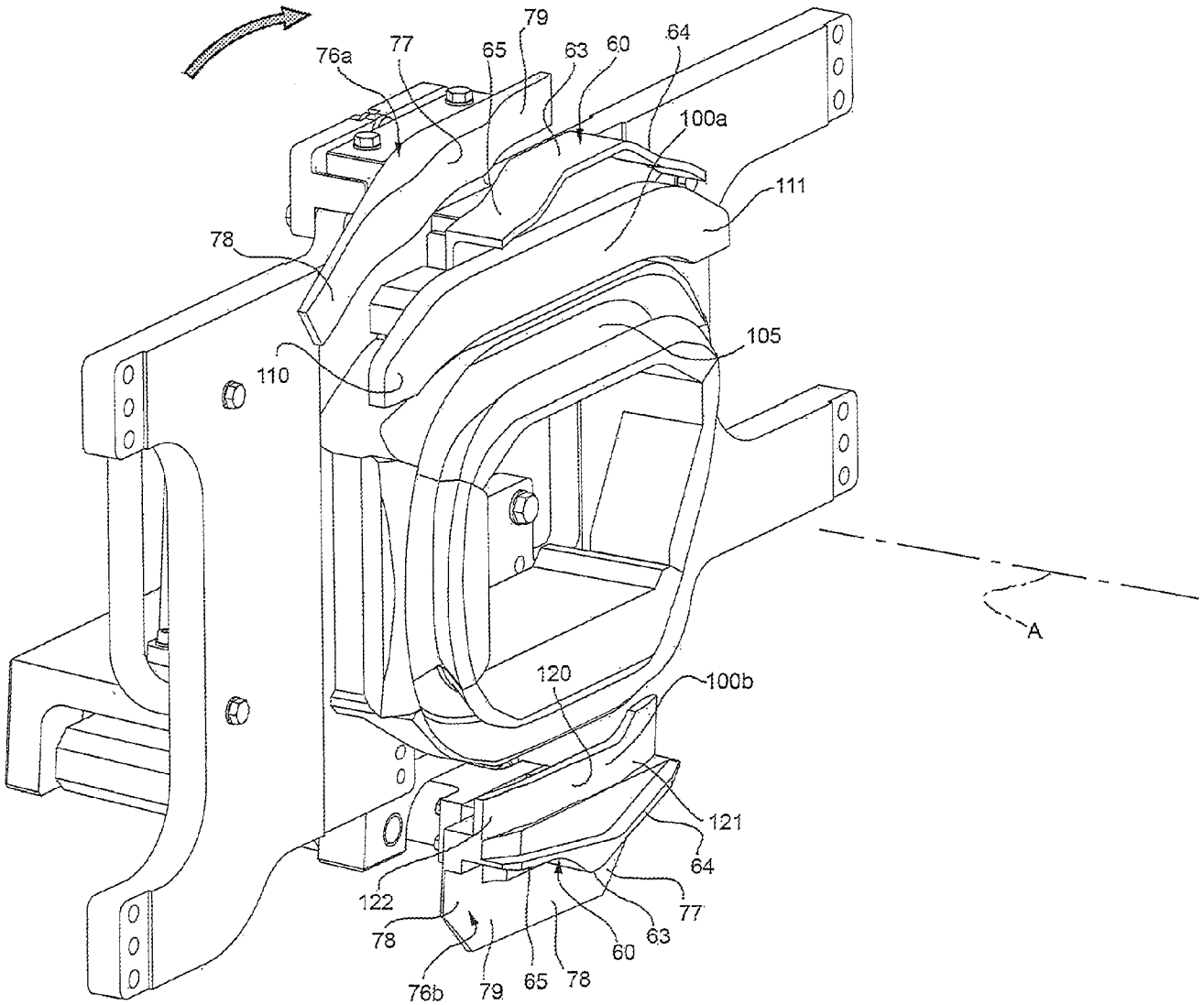
FIG. 3 shows a perspective view of a plurality of cams of the unit in FIG. 1.

With reference to FIGS. 3 to 5, cams 60 are arranged on the opposite side of wheel 28 with respect to vertical wall 43 bearing cams 38, 39 and each have a top portion 65 projecting radially outwards with respect to axis A, from which respective ramp portions 64, 65 depart with opposite inclination; with reference to the rotation direction of wheel 28, ramp portion 64 of each cam 60 increases towards top portion 63, while ramp portion 65 decreases from top portion 63. The sliding of each cam follower roller 58 along each cam 60 at first determines the displacement of gripping member 29 from the first retracted operating position to a second advanced operating position, reached at top portion 63 of cam 60, and then determines the return to the starting position.

In the second advanced operating position, each gripping member 29 is arranged at a maximum radial distance from axis A with reference to the position along the radius occupied by slide element 35 on guide element 33; the withdrawal and the release of opening devices 2 by gripping means 29 respectively take place in the aforementioned second operating position.

With reference to FIGS. 3 to 5, cam 105 is arranged on the opposite side of wheel 28 with respect to vertical wall 43 bearing cams 38, 39, it is fixed and extends continuously about axis A.

Cam 105 further consists of a curvilinear and profiled groove engaged by cam follower rollers 94 of frames 44 of respective gripping members 29.

The sliding of each cam follower roller 94 therein along cam 105 determines the rotation of levers 50 about axes C.

More precisely, cam 105 is configured so that when each gripping member 29 is in station 21 (FIG. 4), axes D are parallel to axis A, and axes E are orthogonal to axis A. Furthermore, plate 53 is orthogonal to axis A at station 21.

In this manner, when each gripping member 29 is in station 21, jaws 67, 68, 69 have respective gripping portions of opening device 2 arranged parallelly to direction Y.

Cam 105 is further configured so that when each gripping member is in station 22 (FIG. 5), axes D, E are inclined with respect to axis A. More precisely, when each gripping member 29 is in station 22, jaws 67, 68, 69 have respective gripping portions of opening device 2 arranged parallelly to direction X.

Cams 100*a*, 100*b* are also arranged on the opposite side of wheel 28 with respect to vertical wall 43 bearing cams 38, 39.

Cam 100*a* has a main portion 110 extending at a constant distance from wheel 28 and an end portion 111 slightly inclined on the opposite side of wheel 28.

The sliding of each cam follower roller 95 along cam 100*a* arranges, at station 21, gripping member 29 in the correct position along direction W to grip opening device 2.

Cam 100*b* is arranged on the opposite side to axis A with respect to cam 100*a*.

Specifically, cam 100*b* has a main portion 120 projecting towards wheel 28 parallelly to axis A and arranged at station 22, from which respective ramp portions 121, 122 depart with opposite inclination; with reference to the rotation direction of wheel 28, ramp portion 121 approaches wheel 28 while ramp portion 122 moves away from wheel 28.

The sliding of each cam follower roller 95 along cam 100*b* determines the displacement of body 47, appendix 54, plate 53 and gripping member 29 parallelly to direction Z and towards wheel 28 at station 22.

Specifically, cam 60 arranged at station 22 and cams 76*b* and 100*b* are defined by a single body.

The operation of unit 1, already partially apparent from the above, is disclosed in the following paragraphs with reference to a single opening device 2 and from the time this opening device 2, already coated with adhesive, passes by station 21.

Gripping member 29 eventually receiving aforementioned opening device 2 is oriented in the optimal withdrawal position by effect of the interaction between cam follower rollers 39, 40 and respective cams 37, 38. Furthermore, by effect of the action of cam 37, frame 44 and slide element 35 slide with respect to guide element 33 until they are in the desired radial position with respect to axis A, to which corresponds a specific peripheral speed of gripping member 29; preferably, the peripheral speed of gripping members 29 at station 21 is higher than the advancing speed of opening devices 2, so as to minimise the impacts between the latter and opening devices 2.

Once station 21 has been reached, gripping member 29 is displaced along direction Y towards advancing path $P_1$ of opening devices 2 in the second advanced operating position by effect of the interaction of its cam follower roller 58 with cam 60, while jaws 68, 69 are rotated in the open position by effect of the interaction of cam follower roller 75 of lever 74 with cam 76*a*.

The interaction of cam follower roller 94 with cam 105 determines the rotation of lever 50 about axis C.

The rotation of lever 50 about axis C takes place simultaneously with and independently from the displacement of gripping member 29 along direction Y.

This rotation arranges axes D parallel to direction A, and axes E, plate 53 and the gripping portions of jaws 67, 68, 69 perpendicular both to axis A and to path $P_1$ (FIG. 4).

Simultaneously, cam follower roller 95 interacts with main portion 110 of cam 100*a* so as to displace fastening body 49 and jaws 67, 68, 69 along direction W and towards wheel 28.

This displacement along direction W determines the shortening of springs 90.

Therefore, gripping member 29 moves on the plane defined by directions Y, W until a correct position is reached with respect to opening device 2 approaching along path $P_1$.

Subsequently, jaws 68, 69 of gripping member 29 are closed again on opening device 2 and gripping member 29 returns to its first retracted operating position, departing from path $P_1$.

The position and advancing speed of gripping member 29 along path $P_3$ are determined by the interaction between cams 37, 38 and cam follower rollers 39, 40; during this stroke, the step between opening devices 2 is taken to the same value $D_2$ as that existing between packages 3.

Near application station 22, the interaction between cam follower roller 58 of gripping member 29 and cam 60 determines the displacement of gripping member 29 along direction X in the second advanced operating position; at the same time, the interaction between cam follower roller 75 of lever 74 and cam 76*b* determines the rotation of jaws 68, 69 in the open position, allowing the release of opening device 2, after the latter has been rested on a package 3.

The interaction of cam follower roller 94 with cam 105 determines the rotation of lever 50 about axis C.

The rotation of lever 50 about axis C at application station 22 takes place simultaneously with and independently from the displacement of gripping member 29 along direction X.

The rotation of lever 50 about axis C arranges axis D parallel to plane wherein the surface 11 will lie, once opening device 2 has been applied onto package 3. Furthermore, the rotation of lever 50 about axis C arranges axis E parallel to the plane wherein flat wall 14*a* will lie, once opening device 2 has been applied onto package 3. Such rotation of lever 50 about axis C arranges axis E, plate 53 and jaws 67, 68, 69 parallel to the plane on which wall 14*a* lies once opening device 2 is applied onto package 3 (FIG. 5).

At the same time, cam follower roller 95 interacts with main portion 120 of cam 100*b* so as to displace fastening body 49 and gripping member 29 along direction Z. This displacement of fastening body 49 along direction Z determines the shortening of springs 90.

In this manner, gripping member 29 moves, during application on package 2, in a plane defined by directions X, Z and, therefore, may displace opening device 2 according to a trajectory such as to arrange portions 12, 13 totally resting on wall 8 and on portion 9 of wall 10 of package 3.

In particular, gripping member 29, when moving along above identified trajectory, tilts about axis C.

Preferably, this trajectory is so shaped that opening device 2, when approaches the package 3, is inclined by at least forty five degrees with respect to a vertical axis of package 3.

Once opening device 2 has been applied on package 3, a pressure member (only diagrammatically shown in FIG. 1) interacts with opening device 2 holding it pressed on package 3 until adhesion of portions 12, 13 is obtained respectively on wall 8 and on portion 9 of wall 10.

Figure 10:
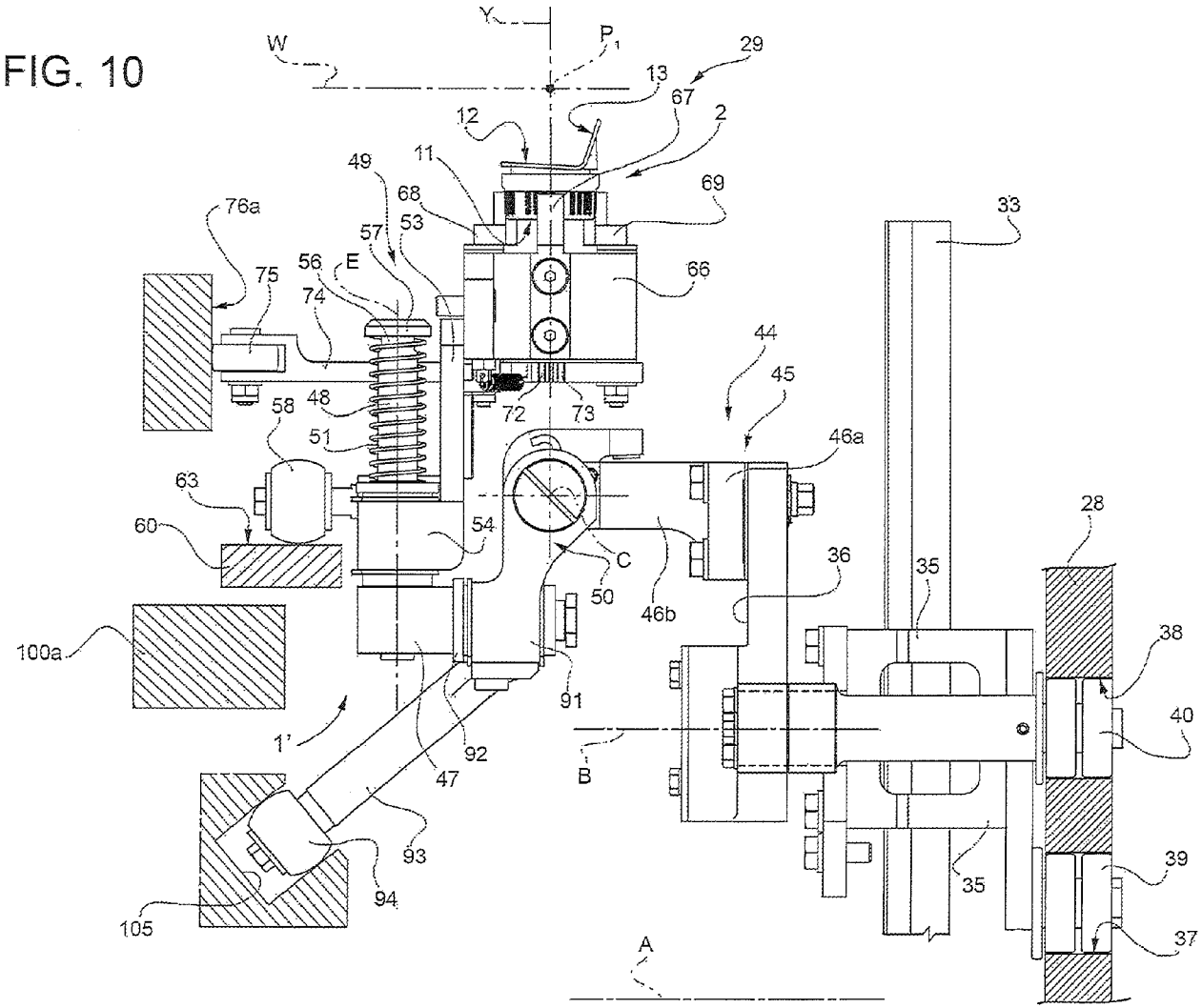
FIGS. 10 and 11 show strongly enlarged views of a gripping member of a unit according to a second embodiment of the present invention.
Figure 11:
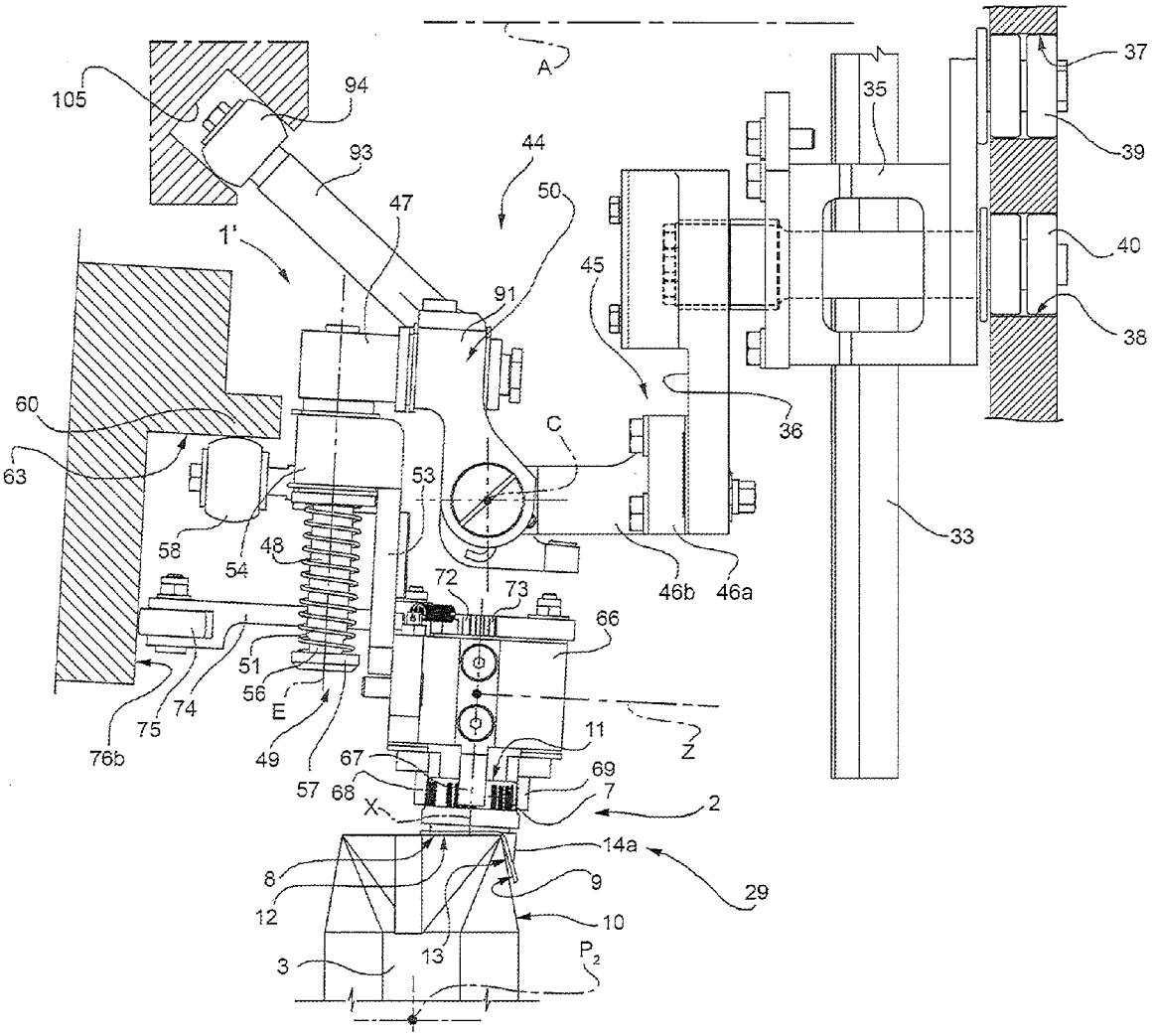

With reference to FIGS. 10 and 11, 1' indicates a unit according to a second embodiment of the present invention.

Unit 1' is similar to unit 1 and will be disclosed hereinafter only insofar as it differs from the latter; corresponding parts or equivalents of units 1, 1' will be indicated, where possible, by the same reference numerals.

Unit 1' differs from unit 1 in that lever 50 of each gripping member 29 is integral with relative body 47.

Accordingly, gripping members 29 of unit 1' no longer comprise respective pins 97 and springs 90. In a completely analogous manner, axes D no longer exist.

Furthermore, unit 1' no longer comprises cam follower rollers 95 and relative cams 100*a*, 100*b*.

Each gripping member 29 of unit 1' is advantageously displaceable, at station 22, with respect to supporting plate 36 in a plane defined by direction X transversal with respect to axis A and path $P_2$, and by axis A.

In particular, direction X coincides with the centreline direction of gripping member 29 at station 22 and is transversal to axis A (FIG. 11).

Furthermore (FIG. 10), each gripping member 29 of unit 1' is displaceable, at station 21, in a plane defined by:

a direction Y perpendicular to axis A and to path $P_1$; and a direction W perpendicular to direction Y and parallel to axis A.

In other words, each gripping member 29 of unit 1' is displaceable, at station 21, in a plane defined by:

direction Y; and axis A.

Direction Y, in particular, coincides with the centreline direction of gripping member 29 at station 21.

The operation of unit 1' differs from the operation of unit 1 in that each gripping member 29 is moved at station 21 on the plane defined by direction Y and axis A at station 21 as a result of:

the interaction of respective cam follower roller 94 with cam 105; and the interaction of respective cam follower roller 58 with cam 60.

More precisely, the interaction of respective cam follower roller 94 with cam 105 determines the rotation of lever 50 about axis C.

However, in normal operation, it is not necessary to tilt lever 50 about axis C, at station 21, and no movement takes place in the direction of axis A.

The interaction of respective cam follower roller 58 with cam 60 displaces each gripping member 29 along direction Y in the second advanced operating position.

The rotation of lever 50 about axis C at station 21 takes place simultaneously with and independently from the displacement of gripping member 29 along direction X, if applicable.

In particular, the interaction, at station 22, of each cam follower roller 94 with cam 105 takes place simultaneously at the interaction of roller 58 with cam 60.

In a completely analogous manner, each gripping member 29 is moved at station 22 on the plane defined by direction X and axis A as a result of:

the interaction of respective cam follower roller 94 with cam 105; and the interaction of respective cam follower roller 58 with cam 60.

More precisely, the interaction of respective cam follower roller 94 with cam 105 determines the rotation of lever 50 about axis C.

The interaction of respective cam follower roller 58 with cam 60 displaces each gripping member 29 along direction X in the first advanced operating position.

The rotation of lever 50 about axis C at station 21 takes place simultaneously with and independently from the displacement of gripping member 29 along direction X.

Finally, as it moves from station 22 and station 21, each gripping member 29 is tilted about axis B of relative supporting plate 36.

From an analysis of the features of unit 1, 1' made according to the present invention, the advantages it allows to obtain are apparent.

Specifically, gripping members 29 may be moved in the plane defined by direction X and axis A at station 22, leading unit 1, 1' to be especially flexible with regard to the approaching trajectory of gripping members 29 to packages 3.

Subsequently, each gripping member 29 may be handled on the aforementioned plane so as to apply portions 12, 13 of respective opening device 2 totally resting on wall 8 and on portion 9 of wall 10 of corresponding package 3, thereby ensuring that the adhesive does not escape from portions 12, 13 once the same are applied on package 3.

Finally, it is apparent that modifications and variants not departing from the scope of protection of the claims may be made to unit 1, 1'.

The invention claimed is:

1. A unit for the application of opening devices on packages of food products pourable into a tube of packaging material, comprising:

first conveying means to feed said opening devices in a sequence along a first path;

second conveying means to feed said packages in a sequence along a second path;

third conveying means movable about a first axis and adapted to displace said opening devices along a third path from a withdrawal station placed along said first path to an application station of the opening devices on said respective packages, placed along said second path;

at least one gripping member for gripping a corresponding opening device, the at least one gripping member including a support body and at least two gripping jaws rotatably attached to the support body and configured to hold the corresponding opening device immovably with respect to the support body; and a supporting plate to support said gripping member; said supporting plate being coupled to said third conveying means;

wherein said gripping member is displaceable, at said application station, with respect to said supporting plate in a first plane defined by said first axis and a first direction transversal to said first axis and to said second path; and wherein said gripping member is rotatable in said first plane about a second axis perpendicular to said first axis and parallel to said second path at said withdrawal station and/or at said application station.

2. The unit according to claim 1, wherein said supporting plate is rotatable about a third axis which is parallel to said first axis.

3. The unit according to claim 2, wherein said supporting plate is rotatable about said third axis in an independent manner with respect to the rotation of said gripping member about said second axis.

4. The unit according to claim 2, wherein said gripping member is rotatable simultaneously about said third axis and about said second axis.

5. The unit according to claim 1, further having constraining means comprising:

a guide element which extends radially outwards from the first axis substantially through a centreline of each supporting plate;

a slide element slidingly coupled to said guide element and bearing said gripping member.

6. The unit according to claim 1, further comprising:

a lever operatively connected with said gripping member, bearing a first cam follower, and tiltable about said second axis; and first cam means cooperating with said first cam follower at least at said application station and said withdrawal station to determine the rotation of said lever about said second axis.

7. The unit according to claim 1, wherein said gripping member is also displaceable at said application station along a second direction transversal to said first direction.

8. The unit according to claim 7, wherein said second direction lies in said first plane.

9. The unit according to claim 7, further comprising: a frame supporting said gripping member with respect to said constraining means; said frame comprising a body fixed to said supporting plate of said constraining means, a second cam follower operatively connected to said gripping member, and an elastic element elongated along a third axis and interposed between said body and said second cam follower.

10. The unit according to claim 9, further comprising: second cam means cooperating with said second cam follower at said application station to displace said second cam follower in a parallel direction to said second direction.

11. The unit according to claim 10, further comprising; a third cam follower and a fourth cam follower operatively connected to said gripping member; and fourth cam means cooperating, at said application station, with said third cam follower to displace said gripping member along said first direction, and fifth cam means cooperating, at said application station, with said fourth cam follower to displace said gripping member from a closed position in which it grips the opening device to an open position in which it applies the opening device on said corresponding package; said second, fourth and fifth cam means being defined by a single body.

12. The unit according to claim 9, further comprising: third cam means cooperating with said second cam follower at said withdrawal station to displace said second cam follower in a parallel direction to said fourth direction.

13. The unit according to claim 12, wherein said elastic element is interposed between said lever and said second cam follower.

14. The unit according to claim 1, wherein said gripping member is displaceable, at said withdrawal station, with respect to said supporting plate in a second plane defined by a third direction transversal to said first axis and to said first path, and by said first axis.

15. The unit according to claim 14, wherein said third direction is radial with respect to said first axis.

16. The unit according to claim 14, wherein said gripping member is also displaceable, at said withdrawal station, along a fourth direction parallel with respect to said first axis; said fourth direction lying in said second plane.

17. The unit according to claim 16, wherein said lever is hinged to said body about said second axis and is operatively connected to said second cam follower.

18. A unit for the application of opening devices on packages of food products pourable into a tube of packaging material, comprising:

a first conveyor to feed the opening devices in a sequence along a first path;

a second conveyor to feed the packages in a sequence along a second path;

a third conveyor movable about a first axis and adapted to displace the opening devices along a third path from a withdrawal station placed along the first path to an application station of the opening devices on the respective packages, placed along the second path;

at least one gripping member for gripping a corresponding opening device;

a supporting plate supporting the gripping member, the supporting plate being coupled to the third conveyor;

wherein the gripping member is displaceable, at the application station, with respect to the supporting plate in a first plane defined by the first axis and a first direction transversal to the first axis and to the second path; and wherein the gripping member is configured to rotate, while gripping the corresponding opening device, about a second axis perpendicular to the first axis and parallel to the second path.

19. A unit for the application of opening devices on packages of food products pourable into a tube of packaging material, comprising:

a first conveyor to feed the opening devices in a sequence along a first path;

a second conveyor to feed the packages in a sequence along a second path;

a third conveyor movable about a first axis and adapted to displace the opening devices along a third path from a withdrawal station placed along the first path to an application station of the opening devices on the respective packages, placed along the second path;

at least one gripping member for gripping a corresponding opening device, the at least one gripping member including a support body and at least one gripping jaw rotatably attached to the support body;

a supporting plate supporting the gripping member, the supporting plate being coupled to the third conveyor;

wherein the gripping member is displaceable along a first direction perpendicular to the second path; and wherein the support body and the at least one gripping jaw of the gripping member are together rotatable with respect to the third conveyor, at the withdrawal station and/or at the application station, about a second axis that is parallel to the second path.

* * * * *